US012577646B2

(12) United States Patent
Hirata et al.

(10) Patent No.: US 12,577,646 B2
(45) Date of Patent: Mar. 17, 2026

(54) COMPOSITE TUBE AND WELDED JOINT

(71) Applicant: NIPPON STEEL CORPORATION, Tokyo (JP)

(72) Inventors: Hiroyuki Hirata, Tokyo (JP); Mitsuru Yoshizawa, Tokyo (JP); Katsuki Tanaka, Tokyo (JP); Takahiro Osuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 91 days.

(21) Appl. No.: 18/249,779

(22) PCT Filed: Aug. 6, 2021

(86) PCT No.: PCT/JP2021/029420

§ 371 (c)(1),
(2) Date: Sep. 28, 2023

(87) PCT Pub. No.: WO2022/102183

PCT Pub. Date: May 19, 2022

(65) Prior Publication Data

US 2024/0240295 A1 Jul. 18, 2024

(30) Foreign Application Priority Data

Nov. 13, 2020 (JP) ..... 2020-189051

(51) Int. Cl.

| | |
|---|---|
| ***C22C 38/58*** | (2006.01) |
| ***C22C 30/02*** | (2006.01) |
| ***C22C 30/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/16*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C22C 38/58* (2013.01); *C22C 30/02* (2013.01); *C22C 30/04* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/10* (2013.01); *C22C 38/12* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search

CPC ..... C22C 38/58; C22C 38/001; C22C 38/002; C22C 38/005; C22C 38/008; C22C 38/02; C22C 38/04; C22C 38/06; C22C 38/10; C22C 38/12; C22C 38/16; C22C 38/42; C22C 38/44; C22C 38/46; C22C 38/48; C22C 38/50; C22C 38/52; C22C 38/54

USPC ..... 428/639

See application file for complete search history.

(56) References Cited

U.S. PATENT DOCUMENTS

| | | | | |
|---|---|---|---|---|
| 5,190,832 | A | 3/1993 | Ogawa et al. | |
| 5,194,222 | A | 3/1993 | Ogawa et al. | |
| 2021/0140569 | A1* | 5/2021 | Abe | C22C 38/60 |

FOREIGN PATENT DOCUMENTS

| | | | |
|---|---|---|---|
| EP | 2813594 | A1 | 12/2014 |
| JP | 04329852 | A | 11/1992 |
| JP | 05017841 | A | 1/1993 |
| JP | 06306518 | A | 11/1994 |
| JP | 07041911 | A | 2/1995 |
| JP | 07090496 | A | 4/1995 |
| JP | 07090540 | A | 4/1995 |
| JP | 08232031 | A | 9/1996 |
| JP | 4221034 | B2 | 2/2009 |

(Continued)

OTHER PUBLICATIONS

Hirata et al., (JP2014084493A Google Patents Machine translation printed on Jan. 11, 2025), May 12, 2014, entire translation (Year: 2014).*

*Primary Examiner* — Katherine A Christy

(74) *Attorney, Agent, or Firm* — Greer, Burns & Crain, Ltd.

(57) ABSTRACT

A composite tube includes a first tube and a second tube. A chemical composition of the first tube includes, in mass %, C: more than 0.060% to 0.400% or less, Si: 0.01 to 1.00%, Mn: 0.01 to 1.20%, P: 0.0350% or less, S: 0.0150% or less, Sn: 0.0005 to 0.0400%, Al: 0.040% or less, N: 0.050% or less, O: 0.030% or less, and the balance: Fe and impurities. A chemical composition of the second tube includes, in mass %, C: 0.003 to 0.100%, Si: 0.01 to 1.50%, Mn: 0.01 to 2.20%, P: 0.0400% or less, S: 0.0100% or less, Sn: 0.0005 to 0.0300%, Ni: 7.0 to 52.0%, Cr: 15.0 to 27.0%, Al: 0.001 to 0.600%, N: 0.001 to 0.150%, O: 0.030% or less, and the balance: Fe and impurities. The composite tube satisfies formulas $[Si_{ave}+6\times P_{ave}+20\times S_{ave}+2\times Sn_{ave}\leq 1.1000]$ and $[0.0015\leq 4\times S_{ave}+Sn_{ave}]$.

4 Claims, 1 Drawing Sheet

(56) References Cited

FOREIGN PATENT DOCUMENTS

| | | | | | |
|---|---|---|---|---|---|
| JP | 2013159840 | A | | 8/2013 | |
| JP | 2014084493 | A | * | 5/2014 | ..... C21D 8/0205 |

* cited by examiner

COMPOSITE TUBE AND WELDED JOINT

TECHNICAL FIELD

The present invention relates to a composite tube and a welded joint.

BACKGROUND ART

The external surface of a heater tube or the like in thermal power generation boilers, waste incineration power generation boilers, and biomass power generation boilers is exposed to a harsh environment such as corrosion due to molten salts under high temperatures as well as wear caused by unburned materials. On the other hand, the internal surface of a heat exchanger tube used in a syngas cooler of an integrated coal gasification combined cycle power plant is exposed to a high temperature corrosive environment.

It is possible to impart excellent corrosion resistance and wear resistance to a composite tube by selecting appropriate materials for the outer tube and the inner tube. Therefore, various composite tubes in which a variety of materials are combined have been proposed for the aforementioned uses as well as for uses such as energy transmission and storage equipment (for example, Patent Documents 1 to 9).

LIST OF PRIOR ART DOCUMENTS

Patent Document

Patent Document 1: JP4-221034A
Patent Document 2: JP4-329852A
Patent Document 3: JP5-17841A
Patent Document 4: JP6-306518A
Patent Document 5: JP7-41911A
Patent Document 6: JP7-90496A
Patent Document 7: JP7-90540A
Patent Document 8: JP8-232031A
Patent Document 9: JP2013-159840A

SUMMARY OF INVENTION

Technical Problem

In this connection, when these composite tubes are used for structures such as heaters, they are assembled by butt welding. The problems that arise during welding of the respective materials that constitute an outer tube or an inner tube of a composite tube as well as measures to deal with such problems have long been studied. However, it is not necessarily the case that sufficient studies have been conducted regarding welding of composite tubes in which different materials are combined.

In particular, in recent years, from the viewpoint of improving working efficiency, in some cases, during multi-layer welding, all layers are welded using welding consumables for austenitic stainless steel or for a Ni-based alloy, and the welding consumables used is not changed for an inner tube portion and an outer tube portion. At such time, there have been cases in which cracking has occurred in the weld metal in the vicinity of a fusion line near the boundary between the inner tube and the outer tube. There is thus a strong need to prevent such cracking. Note that, although it is known that a clad steel plate is similarly made by combining different materials, the aforementioned problem is a problem that becomes noticeable during circumferential welding of a composite tube.

The present invention has been made in view of the current situation that is described above, and an objective of the present invention is to provide a composite tube that prevents cracking occurring in weld metal during butt welding of the tube and with which a sound welded joint can be stably obtained, and a welded joint which uses the composite tube.

Solution to Problem

The gist of the present invention is a composite tube and a welded joint which are described hereunder.

(1) A composite tube including a first tube and a second tube, wherein:

a chemical composition of the first tube includes, in mass %,

C: more than 0.060% to 0.400% or less,
Si: 0.01 to 1.00%,
Mn: 0.01 to 1.20%,
P: 0.0350% or less,
S: 0.0150% or less,
Sn: 0.0005 to 0.0400%,
Al: 0.040% or less,
N: 0.050% or less,
O: 0.030% or less, and
the balance: Fe and impurities;

a chemical composition of the second tube includes, in mass %,

C: 0.003 to 0.100%,
Si: 0.01 to 1.50%,
Mn: 0.01 to 2.20%,
P: 0.0400% or less,
S: 0.0100% or less,
Sn: 0.0005 to 0.0300%,
Ni: 7.0 to 52.0%,
Cr: 15.0 to 27.0%,
Al: 0.001 to 0.600%,
N: 0.001 to 0.150%,
O: 0.030% or less, and
the balance: Fe and impurities; and the composite tube satisfies Formulas (i) and (ii) below:

$$Si_{ave} + 6 \times P_{ave} + 20 \times S_{ave} + 2 \times Sn_{ave} \leq 1.1000 \quad \text{(i)}$$

$$0.0015 \leq 4 \times S_{ave} + Sn_{ave} \quad \text{(ii)}$$

where, the meaning of each symbol in the above formulas is as follows:

$Si_{ave}$: average value (mass %) of contents of Si of first tube and second tube $P_{ave}$: average value (mass %) of contents of P of first tube and second tube $S_{ave}$: average value (mass %) of contents of S of first tube and second tube $Sn_{ave}$: average value (mass %) of contents of Sn of first tube and second tube.

(2) The composite tube according to the above (1), wherein:

the chemical composition of the first tube contains, in lieu of a part of Fe, one or more elements selected from a group of, in mass %, Cr: 9.50% or less,
a total of one or more elements selected from Cu, Ni and Co: 1.00% or less,
a total of Mo and/or W: 4.00% or less, a total of one or more elements selected from V, Nb, Ti and Ta: 1.00% or less, B: 0.0200% or less, a total of Ca and/or Mg: 0.0100% or less, and REM: 0.0500% or less.

(3) The composite tube according to the above (1) or (2), wherein:

the chemical composition of the second tube contains, in lieu of a part of Fe, one or more elements selected from, in mass %, a total of Cu and/or Co: 6.00% or less, a total of Mo and/or W: 8.00% or less, a total of one or more elements selected from V, Nb, Ti and Ta: 2.00% or less, B: 0.0200% or less, a total of Ca and/or Mg: 0.0100% or less, and REM: 0.0500% or less.

(4) A welded joint including the composite tube according to any one of (1) to (3) above.

Advantageous Effects of Invention

According to the present invention, a composite tube can be obtained that prevents cracking occurring in weld metal during butt welding of the tube, and with which a sound welded joint can be stably obtained.

DESCRIPTION OF EMBODIMENTS

Figure 1:
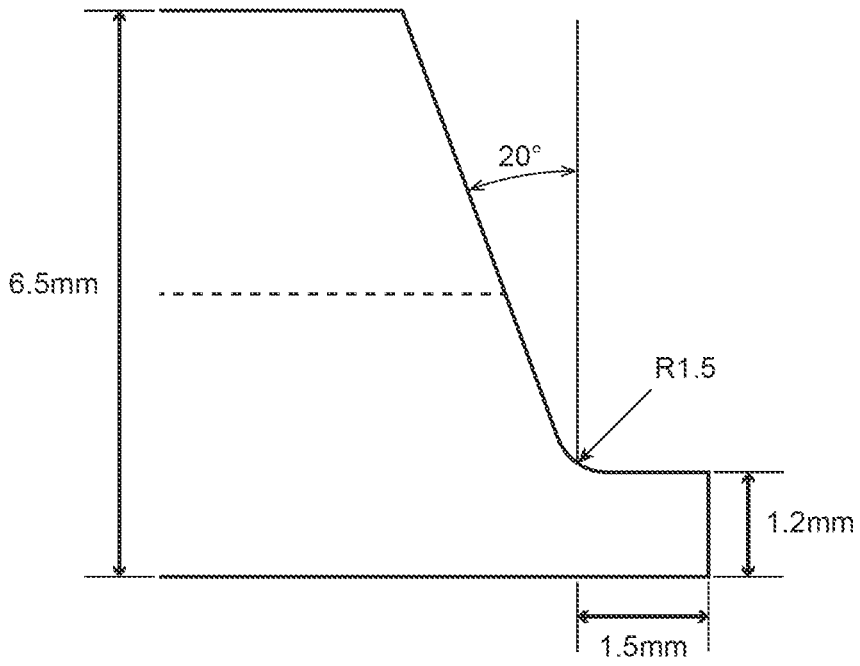
FIG. 1 is a schematic cross-sectional view illustrating the shape of a test material subjected to beveling in the Examples.

To solve the aforementioned problem, the present inventors conducted detailed studies regarding cracking that occurs in weld metal when a composite tube which is composed of a low alloy steel and a high alloy steel that contain 0.0005 to 0.0400% of Sn and 0.0005 to 0.0300% of Sn, respectively with the objective of improving corrosion resistance, is subjected to butt welding using a Ni-based alloy welding consumables. As a result, the findings described hereunder were revealed.

(a) Cracking that occurred during welding occurred in the weld metal in the vicinity of a fusion line near the boundary between the inner tube and the outer tube, that is, in a region in which the inner tube and the outer tube fuse and mix at approximately the same ratio and are particularly susceptible to the influence of the components of the base metals (inner tube and outer tube). The region where cracking occurred exhibited a structure solidified with austenite single phase.

(b) Further, cracking was more liable to occur as the contents of Si, P, S and Sn of the inner tube and the outer tube increased. In addition, cracking occurred at columnar crystal boundaries of the weld metal near the fusion boundary, and concentration of Si, P, S and Sn was confirmed there.

Based on these results, the present inventors considered that cracking occurred due to the following reason.

(c) Si, P, S and Sn are distributed between the liquid phase and the solid phase (austenite phase) during solidification of the weld metal, and concentrate at columnar crystal boundaries which are places where the solid phases meet. Because these elements are all elements that lower the solidus temperature, the present inventors considered that the liquid phase remained at the columnar crystal boundaries until the last stage of solidification, and consequently cracking occurred due to shrinkage stress during solidification.

(d) The present inventors found that in order to stably prevent such cracking, it is necessary to control the average values of the amounts of Si, P, S and Sn contained in the outer tube and the inner tube to be not greater than a range that satisfies a predetermined relationship. As the amounts of these elements are reduced, cracking is less likely to occur in the weld metal.

(e) On the other hand, it has also been clarified that if S and Sn among these elements are extremely reduced, lack of fusion or lack of penetration is liable to occur during multi-pass welding.

(f) S is a surface active element and has an action of strengthening inward convection in the molten pool during welding. Therefore, heat from the arc is easily transmitted in the depth direction, and the weld penetration depth is deepened. Further, Sn evaporates from the molten pool surface during welding and forms a weld energizing path for the arc and increases the current density of the arc, and thus similarly has an effect of deepening the weld penetration depth.

(g) Therefore, it is considered that when the contents of S and Sn are extremely low, the aforementioned effect cannot be sufficiently obtained, and lack of fusion or lack of penetration easily occurs during multi-pass welding.

(h) It has been found that in order to prevent lack of fusion or lack of penetration, it is necessary to control the average values of the contents of S and Sn in the outer tube and the inner tube to be equal to or greater than a range that satisfies a predetermined relationship.

The present invention has been made based on the findings described above. The respective requirements of the present invention are described in detail hereunder.

(A) Overall Structure

A composite tube has a structure in which an outer tube and an inner tube are metallurgically bonded to each other, and is sometimes referred to as a "clad tube". The composite tube according to the present invention includes a first tube and a second tube. In the present invention, depending on the intended use, the first tube may be used as an outer tube and the second tube may be used as an inner tube, or the second tube may be used as an outer tube and the first tube may be used as an inner tube.

Further, the composite tube of the present invention is a seamless tube. In addition, regarding the dimensions of the composite tube, although no particular limitations are set, preferably the outer diameter is 25.4 to 114.3 mm, the thickness is 2.0 to 15.0 mm, and a proportion that the second tube which is composed of high alloy steel that is described hereunder occupies with respect to the thickness of the overall tube is 0.10 to 0.50.

As described hereunder, the first tube is composed of low alloy steel, and the second tube is composed of high alloy steel. The respective chemical compositions of the first tube and the second tube will now be described in detail.

(B) Chemical Composition of First Tube

The reasons for limiting each element are as follows. Note that, the symbol "%" with respect to content in the following description means "mass %".

C: more than 0.060% to 0.400% or less

C dissolves in the matrix or precipitates as a carbide during use at high temperatures, and contributes to securing the strength at room temperature and high temperatures. To obtain this effect, an amount of C that is more than 0.060% is to be contained. However, if C is excessively contained, it will lead to hardening of heat affected zones during butt welding, and will increase low-temperature cracking susceptibility. Therefore, the content of C is to be 0.400% or less. The content of C is preferably more than 0.100%, and more preferably 0.110% or more. Further, the content of C is preferably 0.380% or less, and more preferably 0.350% or less.

Si: 0.01 to 1.00%

Si has a deoxidizing action, and is also an effective element for improving corrosion resistance and oxidation resistance at high temperatures. To obtain these effects, the content of Si is to be 0.01% or more. However, if Si is excessively contained, Si will mix into the weld metal during welding, and will increase the solidification cracking susceptibility. Therefore, it is necessary to make the content of Si 1.00% or less, and also to satisfy a relationship with the contents of P, S and Sn that is described later. The content of Si is preferably 0.03% or more, and more preferably 0.05% or more. Further, the content of Si is preferably 0.90% or less, and more preferably 0.80% or less.

Mn: 0.01 to 1.20%

Mn has a deoxidizing action, similarly to Si, and also contributes to improving the strength by increasing hardenability. To obtain these effects, the content of Mn is to be 0.01% or more. However, if Mn is excessively contained, it will lead to embrittlement during use at high temperatures. Therefore, the content of Mn is to be 1.20% or less. The content of Mn is preferably 0.03% or more, and more preferably 0.05% or more. Further, the content of Mn is preferably 1.10% or less, and more preferably 1.00% or less.

P: 0.0350% or less

P mixes into the weld metal during welding, and thereby increases the solidification cracking susceptibility. Therefore, the content of P is to be 0.0350% or less. In addition, it is necessary for the content of P to satisfy a relationship with the contents of Si, S and Sn that is described later. The content of P is preferably 0.0330% or less, and more preferably 0.0300% or less. Note that, although it is not necessary to particularly set a lower limit of the content of P, and the content of P may be 0 (zero), extremely reducing the content of P will lead to an increase in the steel production cost. In addition, P has a not insignificant effect on increasing the strength. When it is desired to obtain this effect, the content of P is preferably made 0.0015% or more, and more preferably 0.0030% or more.

S: 0.0150% or less

Similarly to P, S mixes into the weld metal during welding, and markedly increases the solidification cracking susceptibility. Therefore, the content of S is to be 0.0150% or less. In addition, it is necessary for the content of S to satisfy a relationship with the contents of Si, P and Sn that is described later. The content of S is preferably 0.0130% or less, and more preferably 0.0100% or less. Note that, although it is not necessary to particularly set a lower limit of the content of S, and the content of S may be 0 (zero), if the content of S is extremely reduced, the weld penetration depth during welding will be small and a lack of fusion is liable to occur. Therefore, the content of S satisfies a relationship with Sn that is described later, and preferably is made 0.0001% or more, and more preferably made 0.0002% or more.

Sn: 0.0005 to 0.0400%

Sn concentrates under scale on the surface of the steel, and has an effect of improving corrosion resistance. Further, Sn mixes into the weld metal during welding and increases the weld penetration depth and thereby suppresses the occurrence of a lack of fusion. To obtain this effect, the content of Sn is to be 0.0005% or more, and must also satisfy a relationship with the content of S that is described later. On the other hand, if excessively contained, Sn will increase the solidification cracking susceptibility during welding. Therefore, the content of Sn is to be 0.0400% or less, and must also satisfy a relationship with the contents of Si, P and Sn described later. The content of Sn is preferably 0.0008% or more, and more preferably 0.0010% or more. Further, the content of Sn is preferably 0.0380% or less, and more preferably 0.0350% or less.

Al: 0.040% or less

Al is contained for the purpose of deoxidation. However, if Al is excessively contained, it will lead to a decrease in toughness. Therefore, the content of Al is to be 0.040% or less. The content of Al is preferably 0.035% or less, and more preferably 0.030% or less. Note that, although it is not necessary to particularly set a lower limit of the content of Al, and the content of Al may be 0 (zero), if the content of Al is extremely reduced, the deoxidation effect will not be sufficiently obtained and the cleanliness of the steel will decrease, and it will also lead to an increase in the production cost. Therefore, the content of Al is preferably made 0.001% or more, and more preferably 0.002% or more.

N: 0.050% or less

If N is excessively contained, it will lead to a decrease in toughness. Therefore, the content of N is to be 0.050% or less. The content of N is preferably 0.045% or less, and more preferably 0.040% or less. Note that, although it is not necessary to particularly set a lower limit of the content of N, and the content of N may be 0 (zero), extremely reducing the content of N will lead to an increase in the steel production cost. In addition, N forms nitrides and has a not insignificant effect on increasing the strength. When it is desired to obtain this effect, the content of N is preferably made 0.001% or more, and more preferably 0.003% or more.

O: 0.030% or less

If O is excessively contained, it will lead to a decrease in workability and ductility. Therefore, the content of O is to be 0.030% or less. The content of O is preferably 0.025% or less, and more preferably 0.020% or less. Note that, although it is not necessary to particularly set a lower limit of the content of O, and the content of O may be 0 (zero), extremely reducing the content of O will lead to an increase in the steel production cost. Therefore, the content of O is preferably made 0.001% or more, and more preferably 0.003% or more.

In the chemical composition of the first tube, the balance is Fe and impurities. Note that, the term "impurity" refers to components which are mixed in due to various factors during the production process when industrially producing a ferrous metal material, including those from raw material such as ore or scrap or the like.

The chemical composition of the first tube may contain one or more elements selected from the following group in lieu of a part of Fe. The reasons are described hereunder.

Cr: 9.50% or less

Total of one or more elements selected from Cu, Ni and Co: 1.00% or less

Total of Mo and/or W: 4.00% or less

Total of one or more elements selected from V, Nb, Ti and Ta: 1.00% or less

B: 0.0200% or less

Total of Ca and/or Mg: 0.0100% or less

REM: 0.0500% or less

Cr: 9.50% or less

Cr is effective for improving corrosion resistance and strength at high temperatures, and therefore may be contained as necessary. However, if Cr is excessively contained, the toughness will decrease. Consequently, when contained, the content of Cr is to be 9.50% or less. The content of Cr is preferably 9.40% or less, and more preferably 9.20% or less. Note that, when it is desired to reliably obtain the aforementioned effect, the content of Cr is preferably 0.01% or more, and more preferably 0.02% or more.

Total of one or more elements selected from Cu, Ni and Co: 1.00% or less

Cu, Ni and Co each increase the hardenability and are effective for improving the strength, and therefore may be contained as necessary. However, since each of these elements is an expensive element, when contained, the total content of one or more elements of element selected from these elements is to be 1.00% or less. The aforementioned total content is preferably 0.90% or less, and more preferably 0.80% or less. Note that, when it is desired to reliably obtain the aforementioned effect, the aforementioned total content is preferably 0.01% or more, and more preferably 0.02% or more.

Total of Mo and/or W: 4.00% or less

Mo and W each dissolve in the matrix and contribute to improving the high temperature strength, and hence each of these elements may be contained as necessary. However, if excessively contained, these elements form coarse intermetallic compounds and/or carbides during use at high temperatures, which leads to a decrease in toughness. Therefore, when contained, the total content of Mo and/or W is to be 4.00% or less. The aforementioned total content is preferably 3.80% or less, and more preferably 3.50% or less. Note that, when it is desired to reliably obtain the aforementioned effect, the aforementioned total content is preferably 0.01% or more, and more preferably 0.02% or more.

Total of one or more elements selected from V, Nb, Ti and Ta: 1.00% or less

V, Nb, Ti and Ta each form fine carbo-nitrides during use at high temperatures and contribute to improving the high temperature strength, and hence each of these elements may be contained as necessary. However, if excessively contained, a large amount of coarse carbo-nitrides will form, which will lead to a decrease in toughness. Therefore, when contained, the total content of one or more elements selected from these elements is to be 1.00% or less. The aforementioned total content is preferably 0.90% or less, and more preferably 0.80% or less. Note that, when it is desired to reliably obtain the aforementioned effect, the aforementioned total content is preferably 0.01% or more, and more preferably 0.02% or more.

B: 0.0200% or less

B increases hardenability and thereby contributes to improving the strength, and therefore may be contained as necessary. However, if B is excessively contained, B will mix into the weld metal during welding and thereby increase the solidification cracking susceptibility. Therefore, when contained, the content of B is to be 0.0200% or less. The content of B is preferably 0.0180% or less, and more preferably 0.0150% or less. Note that, when it is desired to reliably obtain the aforementioned effect, the content of B is preferably 0.0005% or more, and more preferably 0.0010% or more.

Total of Ca and/or Mg: 0.0100% or less

Ca and Mg each improve hot workability, and therefore may be contained as necessary. However, if excessively contained, the Ca and/or Mg will cause the cleanliness to markedly decrease and, on the contrary, will impair the hot workability. Therefore, when contained, the total content of Ca and/or Mg is to be 0.0100% or less. The aforementioned total content is preferably 0.0080% or less, and more preferably 0.0060% or less. Note that, when it is desired to reliably obtain the aforementioned effect, the aforementioned total content is preferably 0.0005% or more, and more preferably 0.0010% or more.

REM: 0.0500% or less

Similarly to Ca and Mg, REM improves hot workability, and therefore may be contained as necessary. However, if excessively contained, the REM will cause the cleanliness to markedly decrease and, on the contrary, will impair the hot workability. Therefore, when contained, the content of REM is to be 0.0500% or less. The content of REM is preferably 0.0400% or less, and more preferably 0.0300% or less. Note that, when it is desired to reliably obtain the aforementioned effect, the content of REM is preferably 0.0005% or more, and more preferably 0.0010% or more.

The term "REM" is a collective term for a total of 17 elements which include Sc, Y, and the lanthanoids, and the content of REM refers to the total content of one or more elements of the REM elements. Further, REM elements are usually contained in misch metal. Therefore, for example, misch metal may be added to an alloy so as to make the content of REM fall within the aforementioned range.

(C) Chemical Composition of Second Tube

The reasons for limiting each element are as follows. Note that, the symbol "%" with respect to content in the following description means "mass %".

C: 0.003 to 0.100%

C stabilizes the austenitic structure and thereby contributes to ensuring high temperature strength. To obtain this effect, the content of C is to be 0.003% or more. However, if C is excessively contained, C forms carbides during welding or during use at high temperatures, which leads to a decrease in corrosion resistance. Therefore, the content of C is to be 0.100% or less. The content of C is preferably 0.005% or more, and more preferably 0.008% or more. Further, the content of C is preferably 0.090% or less, and more preferably 0.080% or less.

Si: 0.01 to 1.50%

Si has a deoxidizing action, and is also an effective element for improving corrosion resistance and oxidation resistance at high temperatures. To obtain these effects, the content of Si is to be 0.01% or more. However, if Si is excessively contained, Si will mix into the weld metal during welding, and will increase the solidification cracking susceptibility, and will also impair the stability of the austenitic structure, leading to a decrease in high temperature strength. Therefore, it is necessary to make the content of Si 1.50% or less, and also for the content of Si to satisfy a relationship with P, S and Sn that is described later. The content of Si is preferably 0.03% or more, and more preferably 0.05% or more. Further, the content of Si is preferably 1.30% or less, and more preferably 1.00% or less.

Mn: 0.01 to 2.20%

Mn has a deoxidizing action, and also increases the stability of the austenitic structure and thereby contributes to ensuring high temperature strength. To obtain these effects, the content of Mn is to be 0.01% or more. However, if Mn is excessively contained, it will lead to embrittlement during use at high temperatures. Therefore, the content of Mn is to be 2.20% or less. The content of Mn is preferably 0.03% or more, and more preferably 0.05% or more. Further, the content of Mn is preferably 2.00% or less, and more preferably 1.80% or less.

P: 0.0400% or less

P mixes into the weld metal during welding, and thereby increases the solidification cracking susceptibility. Therefore, the content of P is to be 0.0400% or less. In addition, it is necessary for the content of P to satisfy a relationship with the contents of Si, S and Sn described later. The content of P is preferably 0.0380% or less, and more preferably 0.0350% or less. Note that, although it is not necessary to particularly set a lower limit of the content of P, and the content of P may be 0 (zero), extremely reducing the content of P will lead to an increase in the steel production cost. In addition, P has a not insignificant effect on increasing the strength. When it is desired to obtain this effect, the content of P is preferably made 0.0030% or more, and more preferably 0.0050% or more.

S: 0.0100% or less

Similarly to P, S mixes into the weld metal during welding, and thereby markedly increases the solidification cracking susceptibility. Further, S increases the liquation cracking susceptibility of heat affected zones. Therefore, the content of S is to be 0.0100% or less. In addition, it is necessary for the content of S to satisfy a relationship with the contents of Si, P and Sn described later. The content of S is preferably 0.0090% or less, and more preferably 0.0080% or less. Note that, although it is not necessary to particularly set a lower limit of the content of S, and the content of S may be 0 (zero), if the content of S is extremely reduced, the weld penetration depth during welding will be small and a lack of fusion is liable to occur. Therefore, the content of S satisfies a relationship with Sn that is described later, and preferably is made 0.0001% or more, and more preferably made 0.0002% or more.

Sn: 0.0005 to 0.0300%

Sn has an effect of improving corrosion resistance. Further, Sn mixes into the weld metal during welding and increases the weld penetration depth and thereby suppresses the occurrence of a lack of fusion. To obtain this effect, the content of Sn is to be 0.0005% or more, and must also satisfy a relationship with the content of S that is described later. On the other hand, if excessively contained, Sn will increase the solidification cracking susceptibility during welding, and also increase the liquation cracking susceptibility of heat affected zones. Therefore, the content of Sn is to be 0.0300% or less, and must also satisfy a relationship with the contents of Si, P and Sn described later. The content of Sn is preferably 0.0008% or more, and more preferably 0.0010% or more. Further, the content of Sn is preferably 0.0280% or less, and more preferably 0.0250% or less.

Ni: 7.0 to 52.0%

Ni stabilizes the austenitic structure and contributes to high temperature strength. In addition, Ni increases corrosion resistance under an environment in which chloride ions are present. To obtain this effect, the content of Ni is to be 7.0% or more. However, since Ni is an expensive element, if Ni is excessively contained, it will lead to an increase in cost. Therefore, the content of Ni is to be 52.0% or less. The content of Ni is preferably 7.2% or more, and more preferably 7.5% or more. Further, the content of Ni is preferably 48.0% or less, and more preferably 45.0% or less.

Cr: 15.0 to 27.0%

Cr contributes to improving oxidation resistance and corrosion resistance at high temperatures. To obtain this effect, the content of Cristo be 15.0% or more. However, if Cr is excessively contained, Cr will impair the stability of the austenitic structure, leading to a decrease in high temperature strength. Therefore, the content of Cr is to be 27.0% or less. The content of Cr is preferably 15.2% or more, and more preferably 15.5% or more. Further, the content of Cr is preferably 26.8% or less, and more preferably 26.5% or less.

Al: 0.001 to 0.600%

Al is contained for the purpose of deoxidation. In addition, Al combines with Ni during use at high temperatures and precipitates as an intermetallic compound, and thereby contributes to improving high temperature strength. To obtain this effect, the content of Al is to be 0.001% or more. However, if Al is excessively contained, it will lead to a decrease in toughness. Therefore, the content of Al is to be 0.600% or less. The content of Al is preferably 0.002% or more, and more preferably 0.003% or more. Further, the content of Al is preferably 0.550% or less, and more preferably 0.500% or less.

N: 0.001 to 0.150%

N stabilizes the austenite phase, and thereby contributes to improving high temperature strength. To obtain this effect, the content of N is to be 0.001% or more. However, if Nis excessively contained, it will lead to a decrease in ductility. Therefore, the content of N is to be 0.150% or less. The content of N is preferably 0.002% or more, and more preferably 0.003% or more. Further, the content of N is preferably 0.130% or less, and more preferably 0.100% or less.

O: 0.030% or less

If O is excessively contained, it will lead to a decrease in workability and ductility. Therefore, the content of O is to be 0.030% or less. The content of O is preferably 0.025% or less, and more preferably 0.020% or less. Note that, although it is not necessary to particularly set a lower limit of the content of O, and the content of O may be 0 (zero), extremely reducing the content of O will lead to an increase in the steel production cost. Therefore, the content of O is preferably made 0.001% or more, and more preferably 0.003% or more.

In the chemical composition of the second tube, the balance is Fe and impurities. Note that, the term "impurity" refers to components which, when industrially producing a ferrous metal material, are mixed in due to various factors during the production process that include being mixed in from raw material such as ore or scrap or the like.

The chemical composition of the second tube may contain one or more kinds selected from the following group in lieu of a part of Fe. The reasons are described hereunder.

Total of Cu and/or Co: 6.00% or less

Total of Mo and/or W: 8.00% or less

Total of one or more elements selected from V, Nb, Ti and Ta: 2.00% or less

B: 0.0200% or less

Total of Ca and/or Mg: 0.0100% or less

REM: 0.0500% or less

Total of Cu and/or Co: 6.00% or less

Cu and Co each increase the stability of the austenitic structure and are effective for improving high temperature strength, and therefore may be contained as necessary. However, each of these elements is an expensive element, and furthermore, excessively containing these elements will lead to a decrease in ductility. Therefore, when contained, the total content of Cu and/or Co is to be 6.00% or less. The aforementioned total content is preferably 5.50% or less, and more preferably 5.00% or less. Note that, when it is desired to reliably obtain the aforementioned effect, the aforementioned total content is preferably 0.01% or more, and more preferably 0.02% or more.

Total of Mo and/or W: 8.00% or less

Mo and W each dissolve in the matrix and contribute to improving high temperature strength, and therefore these elements may be contained as necessary. However, if excessively contained, these elements will impair the stability of the austenitic structure, and will also form coarse intermetallic compounds and/or carbides during use at high temperatures, which will lead to a decrease in toughness. Therefore, when contained, the total content of Mo and/or W is to be 8.00% or less. The aforementioned total content is preferably 7.50% or less, and more preferably 7.00% or less. Note that, when it is desired to reliably obtain the aforementioned effect, the aforementioned total content is preferably 0.01% or more, and more preferably 0.02% or more.

Total of one or more elements selected from V, Nb, Ti and Ta: 2.00% or less

V, Nb, Ti and Ta each form fine carbo-nitrides during use at high temperatures and contribute to improving the high temperature strength, and hence each of these elements may be contained as necessary. However, if excessively contained, a large amount of coarse carbo-nitrides will form, which will lead to a decrease in toughness. Therefore, when contained, the total content of one or more elements selected from these elements is to be 2.00% or less. The aforementioned total content is preferably 1.90% or less, and more preferably 1.80% or less. Note that, when it is desired to reliably obtain the aforementioned effect, the aforementioned total content is preferably 0.01% or more, and more preferably 0.02% or more.

B: 0.0200% or less

B dissolves in carbides during use at high temperatures and is finely dispersed and thereby contributes to improvement of the high temperature strength, and therefore may be contained as necessary. However, if B is excessively contained, B will mix into the weld metal during welding and thereby increase the solidification cracking susceptibility. Therefore, when contained, the content of B is to be 0.0200% or less. The content of B is preferably 0.0180% or less, and more preferably 0.0150% or less. Note that, when it is desired to reliably obtain the aforementioned effect, the content of B is preferably 0.0005% or more, and more preferably 0.0010% or more.

Total of Ca and/or Mg: 0.0100% or less

Ca and Mg each improve hot workability, and therefore may be contained as necessary. However, if excessively contained, the Ca and/or Mg will cause the cleanliness to markedly decrease and, on the contrary, will impair the hot workability. Therefore, when contained, the total content of Ca and/or Mg is to be 0.0100% or less. The aforementioned total content is preferably 0.0080% or less, and more preferably 0.0060% or less. Note that, when it is desired to reliably obtain the aforementioned effect, the aforementioned total content is preferably 0.0005% or more, and more preferably 0.0010% or more.

REM: 0.0500% or less

Similarly to Ca and Mg, REM improves hot workability, and therefore may be contained as necessary. However, if excessively contained, the REM will cause the cleanliness to markedly decrease and, on the contrary, will impair the hot workability. Therefore, when contained, the content of REM is to be 0.0500% or less. The content of REM is preferably 0.0400% or less, and more preferably 0.0300% or less. Note that, when it is desired to reliably obtain the aforementioned effect, the content of REM is preferably 0.0005% or more, and more preferably 0.0010% or more.

The term "REM" is a collective term for a total of 17 elements which include Sc, Y, and the lanthanoids, and the content of REM refers to the total content of one or more elements of the REM elements. Further, REM elements are usually contained in misch metal. Therefore, for example, misch metal may be added to an alloy so as to make the content of REM fall within the aforementioned range.

(D) Average Chemical Composition of First Tube and Second Tube

In addition to the necessity for the first tube and the second tube according to the present invention to have the chemical compositions described above, respectively, it is also necessary for the average chemical composition of the first tube and the second tube to satisfy a predetermined relational expression. The reasons are as follows.

In a case where the composite tube according to the present invention is welded using welding consumables composed of austenitic stainless steel or a Ni alloy, the composite tube (base metal) will melt and the contained Si, P, S and Sn will mix into the weld metal. Each of these elements causes the solidus temperature to decrease, and thus increases the solidification cracking susceptibility of the weld metal. In particular, in weld metal near the fusion boundary, mixing during welding is insufficient, and the chemical composition of the weld metal is dominated by the influence of the base metal.

In addition, because the weld metal becomes a solidified structure of austenite single phase in the vicinity of the boundary between the inner tube and the outer tube, the vicinity of the boundary is influenced by these elements, and therefore solidification cracking is liable to occur. In order to stably prevent solidification cracking occurring in that region, it is necessary to control the average values of the contents of Si, P, S and Sn in the first tube and the second tube so that a relational expression that takes into account the degree of influence of the respective elements is not more than a predetermined range.

Specifically, it is necessary to satisfy the following Formula (i). The left-hand value in Formula (i) below is preferably 1.0500 or less, and more preferably 1.0000 or less.

$$Si_{ave} + 6 \times P_{ave} + 20 \times S_{ave} + 2 \times Sn_{ave} \leq 1.1000 \quad \text{(i)}$$

Where, the meaning of each symbol in the above formula is as follows:

$Si_{ave}$: average value (mass %) of content of Si of first tube and second tube $P_{ave}$: average value (mass %) of content of P of first tube and second tube $S_{ave}$: average value (mass %) of content of S of first tube and second tube $Sn_{ave}$: average value (mass %) of content of Sn of first tube and second tube As mentioned above, the composite tube (base metal) melts during welding, and the contained S and Sn mix into the weld metal. While on the one hand these elements increase weld cracking susceptibility, on the other hand, if these elements are reduced too much, the weld penetration depth during welding will be small and lack of fusion or lack of penetration will be liable to occur. In order to stably prevent lack of fusion or lack of penetration, it is necessary to control the average amounts of the contents of S and Sn of the first tube and the second tube so that a relational expression that takes into account the degree of influence of the respective elements is not less than a predetermined range.

Specifically, it is necessary to satisfy the following Formula (ii). The right-hand value in Formula (ii) below is preferably 0.0020 or more, and more preferably 0.0025 or more.

$$0.0015 \leq 4 \times S_{ave} + Sn_{ave} \quad \text{(ii)}$$

Where, the meaning of each symbol in the above formula is as follows:

$S_{ave}$: average value (mass %) of content of S of first tube and second tube $Sn_{ave}$: average value (mass %) of content of Sn of first tube and second tube (E) Welded Joint A welded joint according to the present invention is a joint that includes the aforementioned composite tube. In other words, the welded joint is a joint in which a plurality of composite tubes are joined together by welding. In the case of assembling composite tubes by butt welding, it suffices to select an appropriate welding consumables according to the intended use.

For example, when welding a composite tube in which the outer tube is the first tube (low alloy steel) and the inner tube is the second tube (high alloy steel), a welded joint having the necessary performance can be obtained by, as is generally performed, welding a high alloy steel portion using welding consumables for austenitic stainless steel or for a Ni-based alloy, and thereafter welding using a pure Ni welding consumables in the vicinity of a boundary portion, and welding using welding consumables for carbon steel for the remaining low alloy steel portion. Further, in a case where the materials constituting the outer tube and the inner tube are the opposite to the above case, welding can be carried out by the reverse method to the method described above.

In addition, in the composite tube according to the present embodiment, even in a case where a plurality of elements of welding consumables as described above are not used and only welding consumables for austenitic stainless steel that solidifies austenite or for a Ni-based alloy is used, a welded joint having the necessary performance can be obtained. Therefore, preferably a welded joint according to one embodiment of the present invention is welded using welding consumables either for austenitic stainless steel or for a Ni-based alloy. Note that, in this case, the welding consumables that is used, and the weld metal that is formed preferably have the following chemical composition.

That is, the chemical composition of the welding consumables and the weld metal is, in mass %, C: 0.003 to 0.100%,
Si: 0.01 to 1.50%,
Mn: 0.01 to 2.50%,
P: 0.0400% or less,
S: 0.0100% or less,
Sn: 0.0300% or less,
a total of Cu and/or Co: 0 to 15.00%,
Ni: 12.0 to 75.0%,
Cr: 18.0% to 27.0%,
a total of Mo and/or W: 0 to 10.00%,
a total of one or more elements selected from V, Nb, Ti and Ta: 0 to 4.00%,
B: 0 to 0.0200%,
a total of Ca and/or Mg: 0 to 0.0100%,
Al: 0.001 to 1.500%,
N: 0.001 to 0.150%,
O: 0.030% or less, and
the balance: Fe and impurities, and
preferably satisfies Formulas (iii) and (iv) below:

$$Si_w + 6 \times P_w + 20 \times S_w + 2 \times Sn_w \leq 1.1000\% \quad \text{(iii)}$$

$$0.0015 \leq 4 \times S_w + Sn_w. \quad \text{(iv)}$$

Where, the meaning of each symbol in the above formulas is as follows:

$Si_w$: content (mass %) of Si of the welding consumables or the weld metal $P_w$: content (mass %) of P of the welding consumables or the weld metal $S_w$: content (mass %) of S of the welding consumables or the weld metal $Sn_w$: content (mass %) of Sn of the welding consumables or the weld metal.

(F) Production Method

Although the method for producing the composite tube is not particularly limited, for example, the composite tube can be produced by subjecting a starting material assembled by inserting a solid billet of high alloy steel or low alloy steel which constitutes the inner tube into a hollow billet of low alloy steel or high alloy steel which constitutes the outer tube to so-called "hot rolling" such as hot extrusion and roll rolling, and integrating the outer tube and the inner tube to make the tube. By this means, a composite tube in which the outer tube is the first tube and the inner tube is the second tube, or a composite tube in which the outer tube is the second tube and the inner tube is the first tube can be obtained.

Note that, normally, in order to ensure the cleanliness of the mating surfaces, assembly of the aforementioned billets is performed in a vacuum or in an inert gas atmosphere. Thereafter, the composite tube subjected to the aforementioned hot rolling may be subjected to cold working such as rolling or drawing, and in addition, a heat treatment may be performed to obtain a composite tube having a required shape.

Hereunder, the present invention is described more specifically by way of Examples. Note that the present invention is not limited to these Examples.

EXAMPLES

Low alloy steels L1 to L7 and high alloy steels H1 to H7 having the chemical compositions shown in Table 1 were combined to prepare, by a hot rolling method, composite tubes having a thickness of 6.5 mm and an outer diameter of 63 mm that each included a first tube composed of low alloy steel and a second tube composed of high alloy steel, and these composite tubes were adopted as test specimen tubes. Note that, in a case where the outer tube was the first tube and the inner tube was the second tube, the thickness of the outer tube was set to 4.2 mm and the thickness of the inner tube was set to 2.3 mm, in other words, the proportion that the thickness of the second tube occupied in the tube overall was made 0.35. On the other hand, in a case where the outer tube was the second tube and the inner tube was the first tube, the thickness of the outer tube was set to 1.6 mm and the thickness of the inner tube was set to 4.9 mm, in other words, the proportion that the thickness of the second tube occupied in the tube overall was made 0.25.

TABLE 1

| Steel | Chemical Composition (mass %; balance: Fe and impurities) | | | | | | | | | | |
|---|---|---|---|---|---|---|---|---|---|---|---|
| | C | Si | Mn | P | S | Sn | Cr | Cu | Co | Ni | Mo |
| L1 | 0.188 | 0.87 | 0.85 | 0.0280 | 0.0043 | 0.0240 | — | — | — | — | — |
| L2 | 0.250 | 0.93 | 0.78 | 0.0330 | 0.0098 | 0.0350 | — | — | — | — | — |
| L3 | 0.185 | 0.87 | 0.92 | 0.0340 | 0.0001 | 0.0010 | — | — | 0.02 | — | — |
| L4 | 0.194 | 0.76 | 0.60 | 0.0310 | 0.0025 | 0.0340 | — | 0.03 | — | — | — |
| L5 | 0.112 | 0.78 | 0.45 | 0.0220 | 0.0012 | 0.0080 | 1.27 | — | — | 0.05 | 0.52 |
| L6 | 0.120 | 0.43 | 0.40 | 0.0220 | 0.0009 | 0.0005 | 1.02 | 0.05 | — | 0.04 | 0.55 |
| L7 | 0.110 | 0.40 | 0.43 | 0.0230 | 0.0006 | 0.0010 | 2.30 | 0.03 | 0.02 | 0.08 | 1.12 |
| H1 | 0.023 | 0.32 | 1.59 | 0.0290 | 0.0010 | 0.0130 | 18.15 | — | — | 8.12 | — |
| H2 | 0.030 | 0.58 | 1.60 | 0.0320 | 0.0025 | 0.0250 | 17.90 | — | — | 7.95 | — |
| H3 | 0.026 | 0.64 | 1.55 | 0.0300 | 0.0001 | 0.0008 | 18.20 | — | — | 8.09 | — |
| H4 | 0.019 | 0.29 | 1.71 | 0.0340 | 0.0004 | 0.0140 | 16.36 | — | — | 10.13 | 2.55 |
| H5 | 0.065 | 0.72 | 1.78 | 0.0160 | 0.0001 | 0.0010 | 25.08 | — | 0.12 | 19.95 | — |
| H6 | 0.071 | 0.41 | 1.26 | 0.0250 | 0.0003 | 0.0020 | 19.75 | 0.80 | — | 30.49 | 0.16 |
| H7 | 0.007 | 0.35 | 0.62 | 0.0180 | 0.0002 | 0.0009 | 21.20 | 1.78 | 0.66 | 40.20 | 2.95 |

| Steel | Chemical Composition (mass %; balance: Fe and impurities) | | | | | | | | | |
|---|---|---|---|---|---|---|---|---|---|---|
| | W | Ti | V | Nb | Ta | Al | B | N | O | Others |
| L1 | — | — | — | — | — | 0.015 | — | 0.006 | 0.007 | |
| L2 | — | — | — | — | — | 0.013 | 0.0048 | 0.017 | 0.008 | |
| L3 | — | — | — | — | — | 0.010 | — | 0.005 | 0.006 | |
| L4 | 0.03 | — | 0.04 | — | — | 0.013 | — | 0.015 | 0.007 | Mg: 0.0010 |
| L5 | — | — | — | 0.04 | 0.02 | 0.009 | — | 0.014 | 0.004 | Ca: 0.0012 |
| L6 | — | 0.05 | — | — | — | 0.008 | — | 0.012 | 0.005 | |
| L7 | 0.04 | — | 0.05 | 0.03 | 0.01 | 0.008 | 0.0008 | 0.009 | 0.004 | REM: 0.0015 |
| H1 | — | — | — | — | — | 0.007 | — | 0.086 | 0.006 | |
| H2 | — | — | — | — | — | 0.009 | — | 0.078 | 0.006 | |
| H3 | — | — | — | 0.04 | — | 0.008 | 0.0052 | 0.096 | 0.006 | |
| H4 | — | — | 0.03 | — | — | 0.008 | — | 0.087 | 0.005 | |
| H5 | 0.05 | 0.06 | — | — | — | 0.008 | — | 0.006 | 0.006 | Ca: 0.0016 |
| H6 | — | 0.46 | 0.04 | — | — | 0.516 | — | 0.007 | 0.005 | Mg: 0.0012 |
| H7 | 0.03 | 0.69 | — | 0.03 | 0.02 | 0.095 | 0.0010 | 0.005 | 0.004 | REM: 0.0020 |

Figure 2:
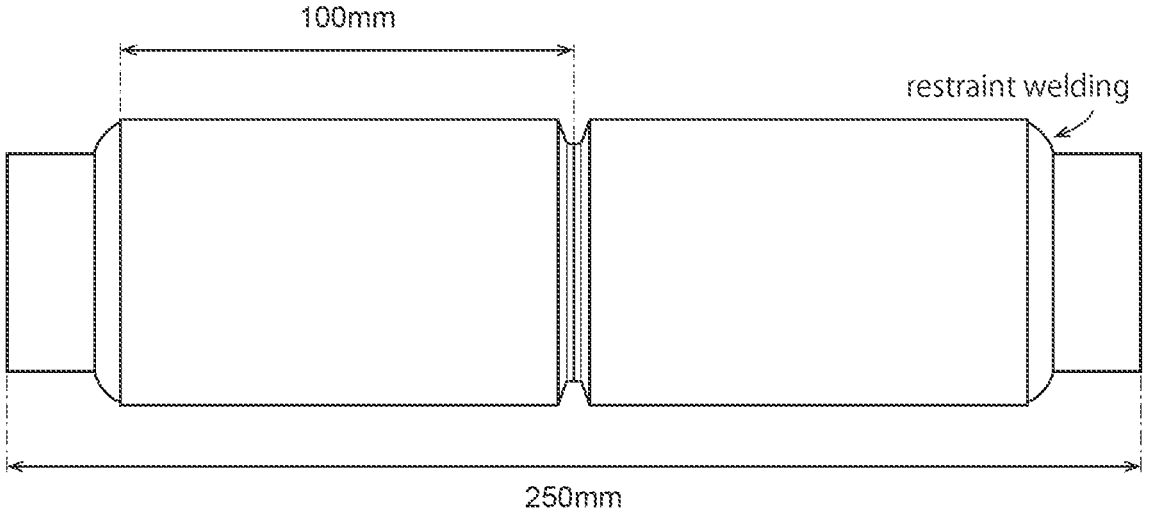
FIG. 2 is a schematic diagram illustrating the shape of a restraint weld test body.

After cutting a test material having a length of 100 mm from each test specimen tube, a bevel illustrated in FIG. 1 was machined at one end of the test material. The bevels of the respective test materials were butted, and a solid rod having an outer diameter of 48 mm and a length of 250 mm which was manufactured by machining from a commercially available steel plate equivalent to SM400B defined in JIS G 3106 (2008) was inserted into the tube. Thereafter, both ends were welded using a covered electrode defined in AWS A5.11-2005 ENiCrMo-3, and two restraint weld test bodies illustrated in FIG. 2 were prepared for each test number.

A filler wire defined in AWS A.5.14-2009 ERNiFeCr-1 having the chemical composition shown in Table 2 was used to perform multi-layer welding by TIG welding with a heat input of 8 to 12 J/cm in the bevel of the restraint weld test body.

Further, from each of the restraint weld test body after multi-layer welding, four test specimens were cut out so that a transverse cross section of the welded joint was the observation surface, and were mirror-polished.

Thereafter, after the test specimens were etched, the presence or absence of defects was examined in a weld zone transverse cross section of a total of eight cross-sections (two test bodies×four transverse cross sections) for each test number using an optical microscope. Test bodies in which neither solidification cracking nor lack of fusion or lack of penetration was observed in all the cross sections were judged to have been accepted or passed as "A", and test bodies in which solidification cracking, or lack of fusion or lack of penetration was observed in only one cross section were judged to have been accepted or passed as "B", while test bodies in which solidification cracking, or lack of fusion

TABLE 2

| Chemical Composition (mass %; balance: Fe and impurities) | | | | | | | | | | | | | |
|---|---|---|---|---|---|---|---|---|---|---|---|---|---|
| C | Si | Mn | P | S | Sn | Cr | Cu | Ni | Mo | Ti | Al | N | O |
| 0.012 | 0.20 | 0.25 | 0.0200 | 0.0015 | 0.0008 | 21.25 | 1.95 | 41.80 | 3.10 | 0.82 | 0.032 | 0.004 | 0.005 |

or lack of penetration was observed in two or more cross sections were judged to have been unaccepted or failed as "F".

The evaluation results are shown in Table 3.

TABLE 3

| Test Number | Outer tube | Inner tube | Left-hand value in Formula (i) | Right-hand value in Formula (ii) | Result of cross-sectional observation <Number of defects/Number of observations> Solidification cracking | Lack of fusion or penetration | Evaluation | |
|---|---|---|---|---|---|---|---|---|
| T1-1 | H1 | L1 | 0.8560 | 0.0291 | 0/8 | 0/8 | A | Inventive example |
| T1-2 | H1 | L2 | 0.9670 | 0.0456 | 0/8 | 0/8 | A | Inventive example |
| T1-3 | H1 | L3 | 0.8090 | 0.0092 | 0/8 | 0/8 | A | Inventive example |
| T1-4 | H1 | L4 | 0.8020 | 0.0305 | 0/8 | 0/8 | A | Inventive example |
| T1-5 | H1 | L5 | 0.7460 | 0.0149 | 0/8 | 0/8 | A | Inventive example |
| T1-6 | H1 | L6 | 0.5605 | 0.0106 | 0/8 | 0/8 | A | Inventive example |
| T1-7 | H1 | L7 | 0.5460 | 0.0102 | 0/8 | 0/8 | A | Inventive example |
| T1-8 | L1 | H1 | 0.8560 | 0.0291 | 0/8 | 0/8 | A | Inventive example |
| T1-9 | L2 | H1 | 0.9670 | 0.0456 | 0/8 | 0/8 | A | Inventive example |
| T1-10 | L3 | H1 | 0.8090 | 0.0092 | 0/8 | 0/8 | A | Inventive example |
| T1-11 | L4 | H1 | 0.8020 | 0.0305 | 0/8 | 0/8 | A | Inventive example |
| T1-12 | L5 | H1 | 0.7460 | 0.0149 | 0/8 | 0/8 | A | Inventive example |
| T1-13 | L6 | H1 | 0.5605 | 0.0106 | 0/8 | 0/8 | A | Inventive example |
| T1-14 | L7 | H1 | 0.5460 | 0.0102 | 0/8 | 0/8 | A | Inventive example |
| T2-1 | H2 | L1 | 1.0220 | 0.0381 | 1/8 | 0/8 | B | Inventive example |
| T2-2 | H2 | L2 | 1.1330 | 0.0546 | 4/8 | 0/8 | F | Comparative example |
| T2-3 | H2 | L3 | 0.9750 | 0.0182 | 0/8 | 0/8 | A | Inventive example |
| T3-1 | H3 | L1 | 0.9978 | 0.0212 | 0/8 | 0/8 | A | Inventive example |
| T3-2 | H3 | L2 | 1.1088 | 0.0377 | 4/8 | 0/8 | F | Comparative example |
| T3-3 | H3 | L3 | 0.9508 | 0.0013 | 0/8 | 2/8 | F | Comparative example |
| T3-4 | H3 | L4 | 0.9438 | 0.0226 | 0/8 | 0/8 | A | Inventive example |
| T3-5 | H3 | L5 | 0.8878 | 0.0070 | 0/8 | 0/8 | A | Inventive example |
| T3-6 | H3 | L6 | 0.7023 | 0.0027 | 0/8 | 0/8 | A | Inventive example |
| T3-7 | H3 | L7 | 0.6878 | 0.0023 | 0/8 | 0/8 | A | Inventive example |
| T3-8 | L1 | H3 | 0.9978 | 0.0212 | 0/8 | 0/8 | A | Inventive example |
| T3-9 | L2 | H3 | 1.1088 | 0.0377 | 3/8 | 0/8 | F | Comparative example |
| T3-10 | L3 | H3 | 0.9508 | 0.0013 | 0/8 | 4/8 | F | Comparative example |
| T4-1 | H4 | L1 | 0.8510 | 0.0284 | 0/8 | 0/8 | A | Inventive example |
| T4-2 | H4 | L2 | 0.9620 | 0.0449 | 0/8 | 0/8 | A | Inventive example |
| T4-3 | H4 | L3 | 0.8040 | 0.0085 | 0/8 | 0/8 | A | Inventive example |
| T5-1 | H5 | L1 | 0.9960 | 0.0213 | 0/8 | 0/8 | A | Inventive example |
| T5-2 | H5 | L2 | 1.1070 | 0.0378 | 4/8 | 0/8 | F | Comparative example |
| T5-3 | H5 | L3 | 0.9490 | 0.0014 | 0/8 | 2/8 | F | Comparative example |
| T5-4 | L1 | H5 | 0.9960 | 0.0213 | 0/8 | 0/8 | A | Inventive example |
| T5-5 | L2 | H5 | 1.1070 | 0.0378 | 3/8 | 0/8 | F | Comparative example |
| T5-6 | L3 | H5 | 0.9490 | 0.0014 | 0/8 | 3/8 | F | Comparative example |
| T6-1 | H6 | L1 | 0.8710 | 0.0222 | 0/8 | 0/8 | A | Inventive example |
| T6-2 | H6 | L2 | 0.9820 | 0.0387 | 0/8 | 0/8 | A | Inventive example |
| T6-3 | H6 | L3 | 0.8240 | 0.0023 | 0/8 | 0/8 | A | Inventive example |
| T7-1 | H7 | L1 | 0.8179 | 0.0215 | 0/8 | 0/8 | A | Inventive example |
| T7-2 | H7 | L2 | 0.9289 | 0.0380 | 0/8 | 0/8 | A | Inventive example |
| T7-3 | H7 | L3 | 0.7709 | 0.0016 | 0/8 | 1/8 | B | Inventive example |
| T7-4 | H7 | L4 | 0.7639 | 0.0229 | 0/8 | 0/8 | A | Inventive example |
| T7-5 | H7 | L5 | 0.7079 | 0.0073 | 0/8 | 0/8 | A | Inventive example |
| T7-6 | H7 | L6 | 0.5224 | 0.0029 | 0/8 | 0/8 | A | Inventive example |
| T7-7 | H7 | L7 | 0.5079 | 0.0026 | 0/8 | 0/8 | A | Inventive example |

$Si_{ave} + 6 \times P_{ave} + 20 \times S_{ave} + 2 \times Sn_{ave}$ ? 1.1000 . . . (i) 0.0015 ? $4 \times S_{ave} + Sn_{ave}$ . . . (ii)

As will be understood from Table 3, with the composite tubes satisfying all the provisions of the present invention, a defect such as solidification cracking or lack of fusion or lack of penetration did not occur in the weld metal, and a sound welded joint was obtained. Note that, it was confirmed that the chemical composition of the obtained weld metal satisfied the conditions regarding the preferable chemical composition described above.

In contrast, in Test Numbers T2-2, T3-2, T3-9, T5-2 and T5-5, because Formula (i) was not satisfied, solidification cracking occurred in the weld metal in the vicinity of the fusion line near the boundary between the inner tube and the outer tube. Further, in Test Numbers T3-3, T3-10, T5-3 and T5-6, because Formula (ii) was not satisfied, the bevel face did not sufficiently melt, and a so-called "lack of fusion or lack of penetration" occurred.

Although the chemical compositions of weld metals of these welded joints that did not satisfy the present invention did, on average, satisfy the aforementioned preferable chemical composition range, it was determined that Formula (i) or Formula (ii) was not satisfied in a local region of the weld metals near the fusion boundary of the boundary between the outer tube and the inner tube, and consequently solidification cracking, or lack of fusion or lack of penetration occurred.

As is clear from the foregoing, it can be seen that a sound welded joint can be obtained only when a composite tube satisfying all the provisions of the present invention is used.

INDUSTRIAL APPLICABILITY

According to the present invention, a composite tube can be obtained that prevents cracking occurring in weld metal during butt welding of the tube and with which a sound welded joint can be stably obtained.

The invention claimed is:

1. A composite tube comprising a first tube and a second tube, wherein:

a chemical composition of the first tube consists of, in mass %,

C: 0.110 to 0.400%,

Si: 0.01 to 1.00%,

Mn: 0.01 to 1.20%,

P: 0.0350% or less,

S: 0.0150% or less,

Sn: 0.0005 to 0.0400%,

Al: 0.040% or less,

N: 0.050% or less,

O: 0.030% or less, the balance: Fe and impurities, and wherein, in lieu of a part of Fe, one or more elements selected from a group of, in mass %, a total of one or more elements selected from Cu, Ni and Co: 1.00% or less, a total of Mo and/or W: 4.00% or less, a total of one or more elements selected from V, Nb, Ti and Ta: 1.00% or less, B: 0.0200% or less, a total of Ca and/or Mg: 0.0100% or less, and REM: 0.0500% or less;

a chemical composition of the second tube comprises, in mass %,

C: 0.003 to 0.100%,

Si: 0.01 to 1.50%,

Mn: 0.01 to 2.20%,

P: 0.0400% or less,

S: 0.0100% or less,

Sn: 0.0005 to 0.0300%,

Ni: 7.0 to 52.0%,

Cr: 15.0 to 27.0%,

Al: 0.001 to 0.600%,

N: 0.001 to 0.150%,

O: 0.030% or less, and the balance: Fe and impurities; and the composite tube satisfies Formulas (i) and (ii) below:

$$Si_{ave} + 6 \times P_{ave} + 20 \times S_{ave} + 2 \times Sn_{ave} \leq 1.1000 \quad \text{(i)}$$

$$0.0015 \leq 4 \times S_{ave} + Sn_{ave} \quad \text{(ii)}$$

where, the meaning of each symbol in the above formulas is as follows:

$Si_{ave}$: (mass % of Si in the first tube+mass % of Si in the second tube)/2, $P_{ave}$: (mass % of P in the first tube+mass % of P in the second tube)/2, $S_{ave}$: (mass % of S in the first tube+mass % of S in the second tube)/2, $Sn_{ave}$: (mass % of Sn in the first tube+mass % of Sn in the second tube)/2.

2. The composite tube according to claim 1, wherein:

the chemical composition of the second tube contains, in lieu of a part of Fe, one or more elements selected from, in mass %, a total of Cu and/or Co: 6.00% or less, a total of Mo and/or W: 8.00% or less, a total of one or more elements selected from V, Nb, Ti and Ta: 2.00% or less, B: 0.0200% or less, a total of Ca and/or Mg: 0.0100% or less, and REM: 0.0500% or less.

3. A welded joint comprising the composite tube according to claim 1.

4. A welded joint comprising the composite tube according to claim 2.

* * * * *